US008269711B2

(12) United States Patent
Hsiao et al.

(10) Patent No.: US 8,269,711 B2
(45) Date of Patent: Sep. 18, 2012

(54) LCD DEVICE OF IMPROVEMENT OF FLICKER UPON SWITCHING FRAME RATE AND METHOD FOR THE SAME

(75) Inventors: Chung-Chih Hsiao, Yangmei Town (TW); Jiao-Lin Huang, Bade (TW); Ming-Xian Li, Longtan Shiang (TW)

(73) Assignee: Chunghwa Picture Tubes, Ltd., Bade, Taoyuan (TW)

( * ) Notice: Subject to any disclaimer, the term of this patent is extended or adjusted under 35 U.S.C. 154(b) by 432 days.

(21) Appl. No.: 12/577,709

(22) Filed: Oct. 12, 2009

(65) Prior Publication Data

US 2010/0295765 A1 Nov. 25, 2010

(30) Foreign Application Priority Data

May 19, 2009 (TW) ..... 098116608 A

(51) Int. Cl.
*G09G 3/36* (2006.01)

(52) U.S. Cl. ..... 345/99

(58) Field of Classification Search ..... 345/98–99
See application file for complete search history.

(56) References Cited

U.S. PATENT DOCUMENTS

2005/0195141 A1* 9/2005 Takeda ..... 345/87
2010/0245316 A1* 9/2010 Cheng ..... 345/211
2011/0102414 A1* 5/2011 Lin et al. ..... 345/213

* cited by examiner

*Primary Examiner* — Chanh Nguyen
*Assistant Examiner* — Jonathan Blancha
(74) *Attorney, Agent, or Firm* — Cheng-Ju Chiang

(57) ABSTRACT

An LCD (Liquid Crystal Display) Device of improvement of flicker upon switching frame rate and method for the same are proposed. The LCD device includes a pixel matrix, a timing controller and a gate driver. The timing controller outputs a first Gate-On-Enable signal to the gate driver, when the LCD device displays frame according to a first frame rate. When the first frame rate is switched to a second frame rate, the timing controller outputs a second Gate-On-Enable signal to the gate driver to cause a charge time of the pixel matrix to be unchanged. It is appreciated that a pulse width of the second Gate-On-Enable signal is equal to a summation of a pulse width of the first Gate-On-Enable signal and an adjusted pulse width.

11 Claims, 5 Drawing Sheets

LCD DEVICE OF IMPROVEMENT OF FLICKER UPON SWITCHING FRAME RATE AND METHOD FOR THE SAME

BACKGROUND OF THE INVENTION

1. Field of the Invention

The present invention is related to a driving method of a liquid crystal display (LCD), and more especially, to a LCD of improvement of flicker upon switching frame rate and the driven method for the same.

2. Description of Prior Art

With a rapid development of monitor types, novel and colorful monitors with high resolution, e.g., liquid crystal displays (LCDs), are indispensable components used in various electronic products such as monitors for notebook computers, personal digital assistants (PDAs), digital cameras, and projectors. The demand for the novelty and colorful monitors has increased tremendously.

Referring to FIG. 1, a block diagram of a conventional liquid crystal display (LCD) device 10, the LCD device 10 comprises a pixel matrix 12 having a plurality of pixel units 20, a gate driver 14, and a source driver 16. Each pixel unit 20 comprises a transistor 22, a storage capacitor $C_S$, and a liquid crystal capacitor $C_{LC}$. The gate driver 14 outputs scanning signals to cause the transistors 22 in each row to be switched on in order. The source driver 16 outputs corresponding data signals to a whole row of pixel units 20 to cause the liquid crystal capacitors $C_{LC}$ to be charged up to respective required voltage. Alignment of liquid crystal molecules between the liquid crystal capacitors $C_{LC}$ is adjusted to exhibit different gray levels according to the voltage level of the data signals. Once the pixel units 20 in the same row finish being charged, the gate driver 14 switches off the scanning signal of the row and then outputs the scanning signal to switch on the transistor 22 in the next row, and sequently, the source driver 16 charges and/or discharges the liquid crystal capacitor $C_{LC}$ of the pixel units 20 in the next row. A sequence like the above continues until all of the pixel units 20 of the pixel matrix 12 finish being charged. Afterwards, the pixel units 20 in the first row start to be recharged. Once the pixel units 20 in each row finish being scanned, the storage capacitor $C_S$ stores voltage based on the data signal so that until the next scanning signal arrives, each pixel unit 20 can let the liquid crystal molecules between the liquid crystal capacitor $C_{LC}$ retain the same direction of rotation to exhibit fixed gray levels depending on voltage based on the data signal stored in the storage capacitor $C_S$.

In the current design of the liquid crystal display panels, taking a pixel matrix 12 with a resolution of 1366×768 and a 60 Hz frame rate for example, the display time of each frame is approximately 1/60=16.67 ms. And, the pixel units 20 need to be charged and/or discharged to the required voltage within 14.63 μs to exhibit their corresponding gray levels according to the data signal output by the source driver 16.

In order to reduce power consumption of LCDs, a so-called Seamless Display Refresh Switch Technology (SDRRS) is frequently adopted nowadays. The technology is related that the frame rate is automatically lowered when the frame remains constantly unchanged, for instance, the frame rate being switched from 60 Hz to 40 Hz. Referring to FIG. 2, it shows a timing diagram of a Gate-On-Enable signal OE upon the frame rate being switched from 60 Hz to 40 Hz. When the frame rate is 60 Hz, the liquid crystal capacitor $C_{LC}$ of the pixel unit 20 is charged and/or discharged within Ta (approximately 14.63 μs). When the frame rate is 40 Hz, the liquid crystal capacitor $C_{LC}$ of the pixel unit 20 is charged and/or discharged within Tb (approximately 21.95 μs). The required time $T_{TFT}$ for the liquid crystal capacitor $C_{LC}$ to be charged is approximately 15.3 μs, leading to $Ta<T_{TFT}<Tb$ as the frame rate is switched. That is to say, the liquid crystal capacitor $C_{LC}$ fails to be charged to a required voltage within Ta; and contrarily, the liquid crystal capacitor $C_{LC}$ is able to be charged to the required voltage within Tb. Because of the difference in charge time between Ta and Tb, the difference in brightness that the gray levels exhibited at the instant of the switch of the liquid crystal capacitor $C_{LC}$ causes the frame to flicker.

SUMMARY OF THE INVENTION

It is therefore an object of the present invention is to provide a liquid crystal display (LCD) device of improvement of flicker upon switching frame rate and the relative driving method for the same. In order to solve problems occurred in prior art, different charge times of liquid crystal capacitors are set as the same value upon frame rate being switched.

Briefly summarized, the present invention provides a method of driving a liquid crystal display (LCD) device, the LCD device comprises a pixel matrix, a timing controller and a gate driver. The method comprises: (a) the timing controller outputting the first Gate-On-Enable signal to the gate driver, when the LCD device displays frame according to a first frame rate; and (b) when the first frame rate is switched to a second frame rate, the timing controller outputting a second Gate-On-Enable signal to the gate driver to cause a charge time of the pixel matrix to be unchanged, wherein a pulse width of the second Gate-On-Enable signal is equal to a summation of a pulse width of the first Gate-On-Enable signal and an adjusted pulse width N(clk).

In one aspect of the present invention, the adjusted pulse width N(clk) is determined by a total number of horizontal pixels, the pulse width OE(clk) of the first Gate-On-Enable signal, and a ratio K of the second frame rate and the first frame rate. As it is, the adjusted pulse width N(clk) is as a function of $(K-1)\times(OE(clk)-H_{total})$.

In another aspect of the present invention, the timing controller is used for generating a horizontal initial impulse in response to a falling edge of the first Gate-On-Enable signal or the second Gate-On-Enable signal. The LCD device further comprises a source driver for outputting a data signal to the pixel matrix upon receiving the horizontal initial impulse, so that the pixel matrix exhibits grey level based on the data signal.

According to the present invention, a liquid crystal display (LCD) device comprises a pixel matrix for displaying an image, and a timing controller for outputting a second Gate-On-Enable signal to the gate driver to cause a charge time of the pixel matrix to be unchanged, when detecting a first frame rate is switched to a second frame rate, wherein a pulse width of the second Gate-On-Enable signal is equal to a summation of a pulse width of the first Gate-On-Enable signal and an adjusted pulse width N(clk).

In one aspect of the present invention, the adjusted pulse width N(clk) is determined by a total number of horizontal pixels, the pulse width OE(clk) of the first Gate-On-Enable signal, and a ratio K of the second frame rate and the first frame rate. As such, the adjusted pulse width N(clk) is as a function of $(K-1)\times(OE(clk)-H_{total})$.

In another aspect of the present invention, the LCD device further comprises a gate driver coupled to the pixel matrix, and a source driver. The gate driver is used for outputting a scanning signal to the pixel matrix upon receiving the first Gate-On-Enable signal or the second Gate-On-Enable signal. The timing controller is used for generating a horizontal initial impulse in response to a falling edge of the first Gate-On-Enable signal or the second Gate-On-Enable signal. The source driver is used for outputting a data signal to the pixel matrix upon receiving the horizontal initial impulse, so that the pixel matrix exhibits grey level based on the data signal These and other objects of the claimed invention will no doubt become obvious to those of ordinary skill in the art after reading the following detailed description of the preferred embodiment that is illustrated in the various figures and drawings.

DETAILED DESCRIPTION OF THE PREFERRED EMBODIMENTS

Figure 1:
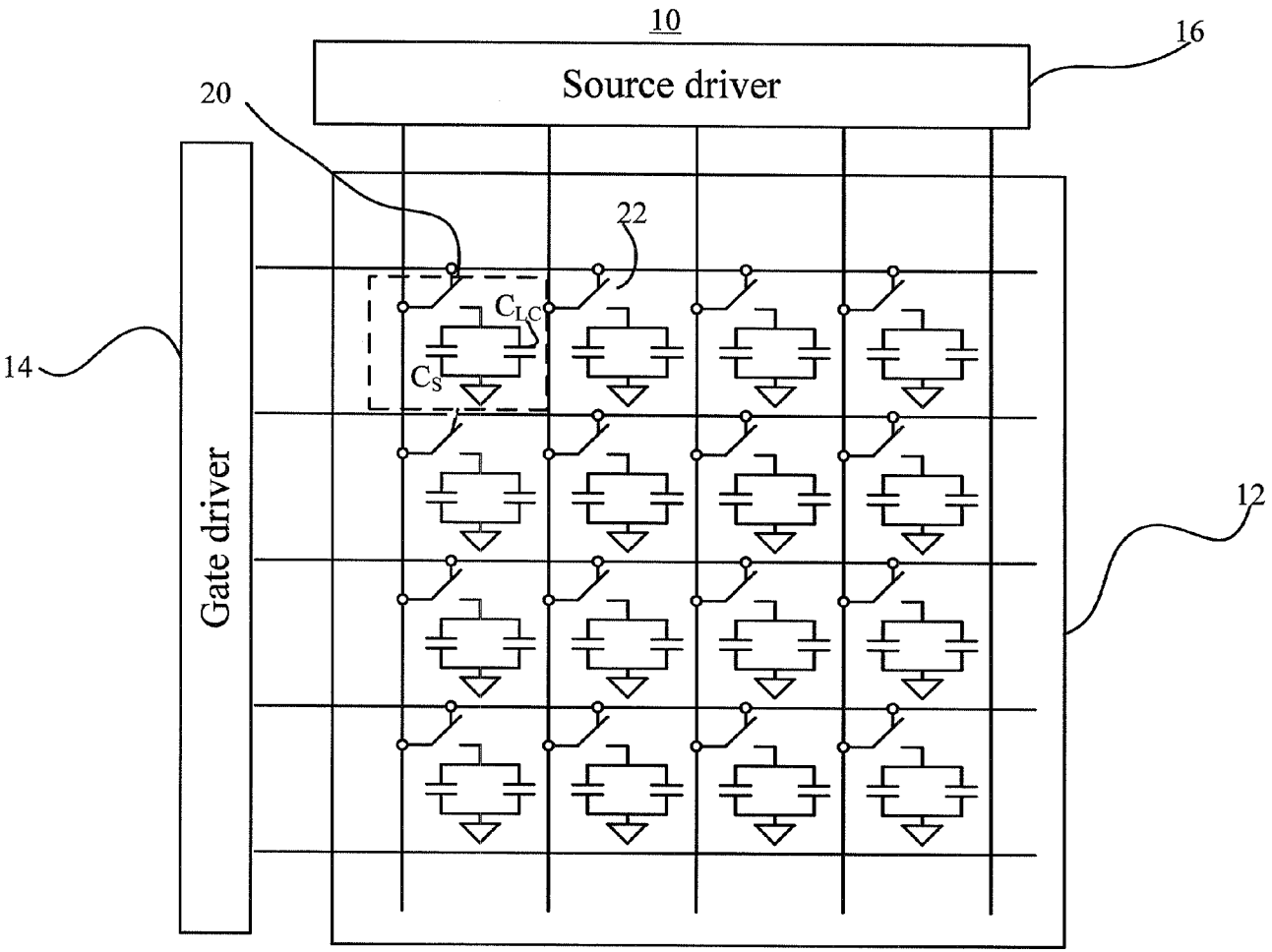
FIG. 1 is a block diagram of a conventional liquid crystal display (LCD) device.
Figure 2:
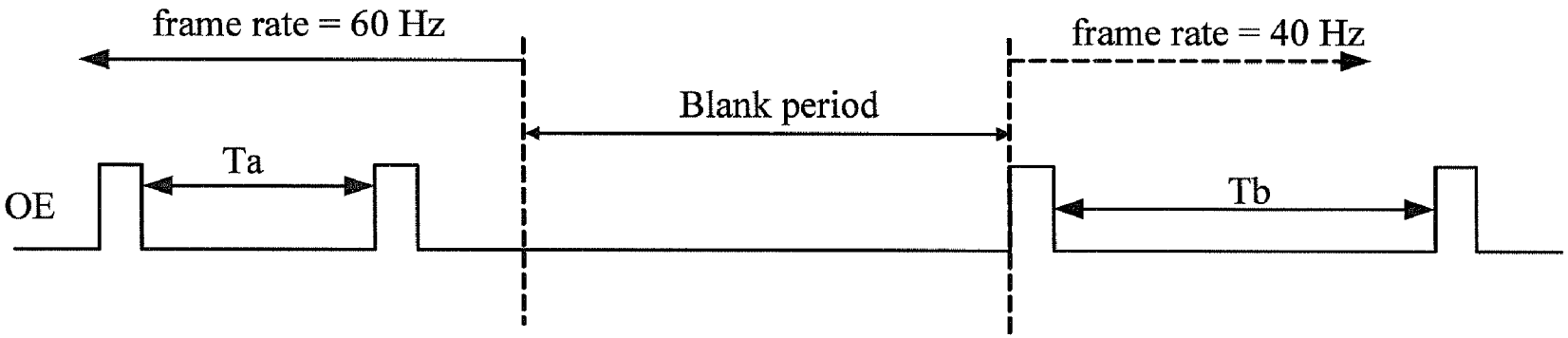
FIG. 2 shows a timing diagram of a Gate-On-Enable signal OE upon the frame rate being switched from 60 Hz to 40 Hz.
Figure 3:
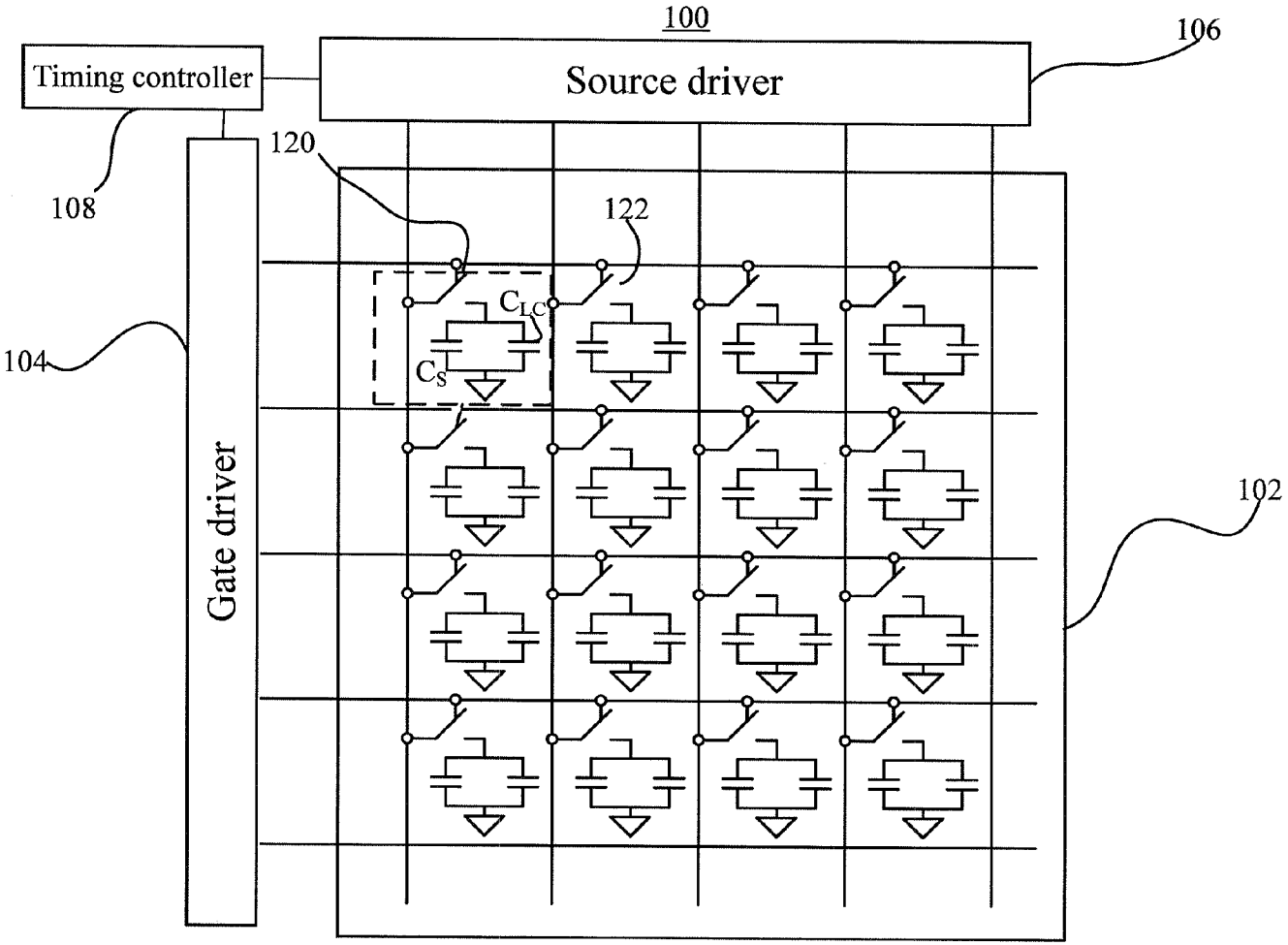
FIG. 3 is a block diagram of a liquid crystal display (LCD) device according to a preferred embodiment of the present invention.

Referring to FIG. 3, a block diagram of a liquid crystal display (LCD) device 100 according to a preferred embodiment of the present invention, the LCD device 100 comprises a pixel matrix 102 having a number of m×n pixel units 120, a gate driver 104, a source driver 106, and a timing controller 108. Each pixel unit 120 comprises a transistor 122, a storage capacitor $C_S$, and a liquid crystal capacitor $C_{LC}$. In this embodiment, take m=1500, n=800 as an example for illustration. The gate driver 104 and the source driver 106 are coupled to the timing controller 108. Upon receiving a Gate-On-Enable signal OE generated by the timing controller 108, the gate driver 104 periodically outputs a scanning signal to turn on each transistor 122 of the pixel units 120 row by row, meanwhile, each pixel unit 120 is charged to a corresponding voltage based on a data signal from the source driver 106 via the timing controller 108, to show various gray levels. After the liquid crystal capacitors $C_{LC}$ on a row of pixel units is finished being charged, the gate driver 104 stops outputting the scanning signal to this row, and then outputs the scanning signal to turn on the transistors 122 of the pixel units of the next row. As soon as the transistor 122 receives the scanning signal, the liquid crystal capacitor $C_{LC}$ is charged to the corresponding voltage based on the data signal to adjust an alignment of liquid crystal molecules to showing various gray levels. Sequentially, until all pixel units 120 finish being charged, the gate driver 104 outputs the scanning signal to the first row again and repeats the above-mentioned mechanism. Once the pixel units 120 in each row finish being scanned, the storage capacitor $C_S$ stores voltage based on the data signal so that until the next scanning signal arrives, each pixel unit 120 can let the liquid crystal molecules inside the liquid crystal capacitor $C_{LC}$ retain the same direction of rotation to exhibit fixed gray levels depending on voltage based on the data signal stored in the storage capacitor $C_S$.

Figure 4:
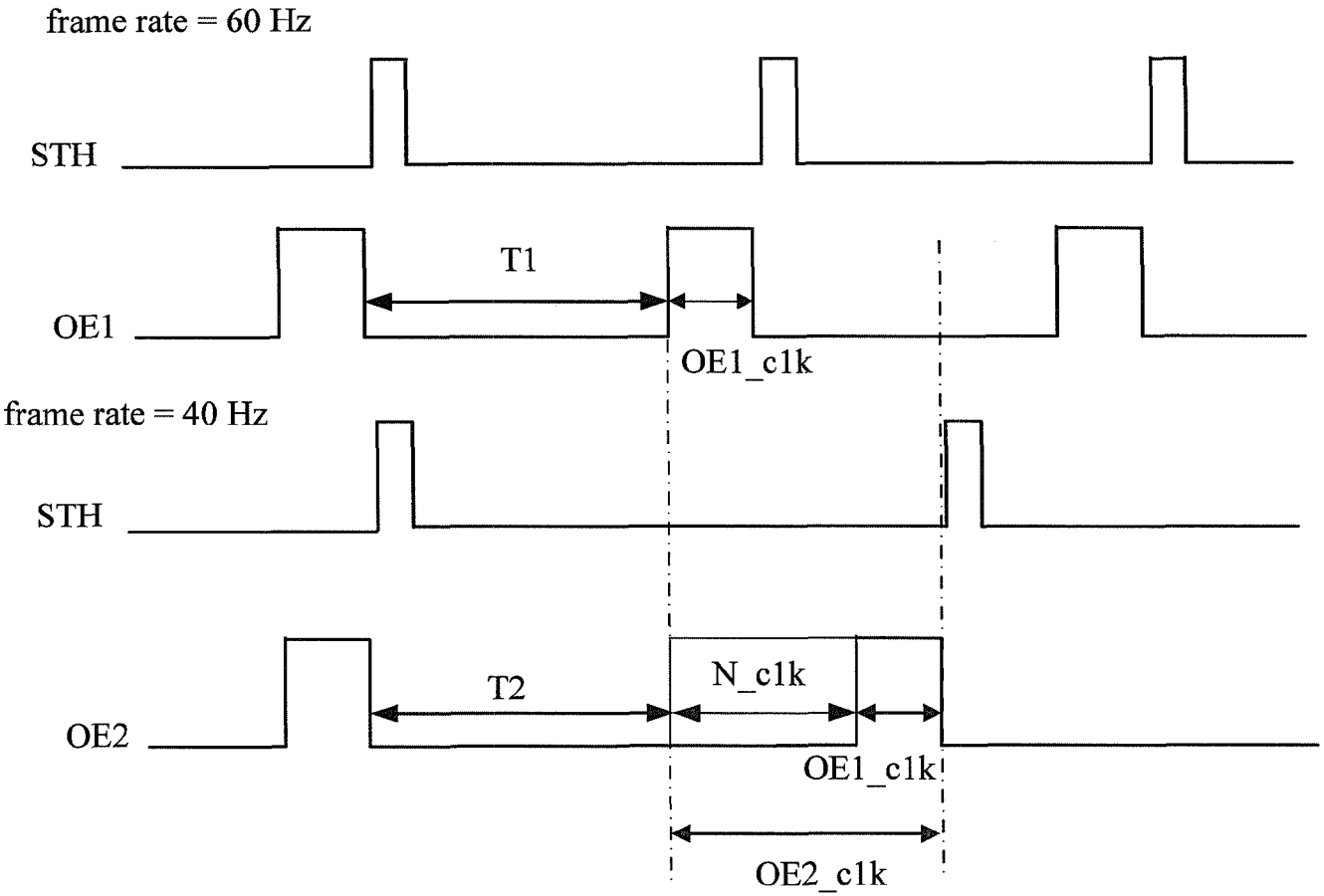
FIG. 4 demonstrates a timing diagram of a first Gate-On-Enable signal OE1 and a second Gate-On-Enable signal OE2 upon frame rate being switched from 60 Hz to 40 Hz.
Figure 5:
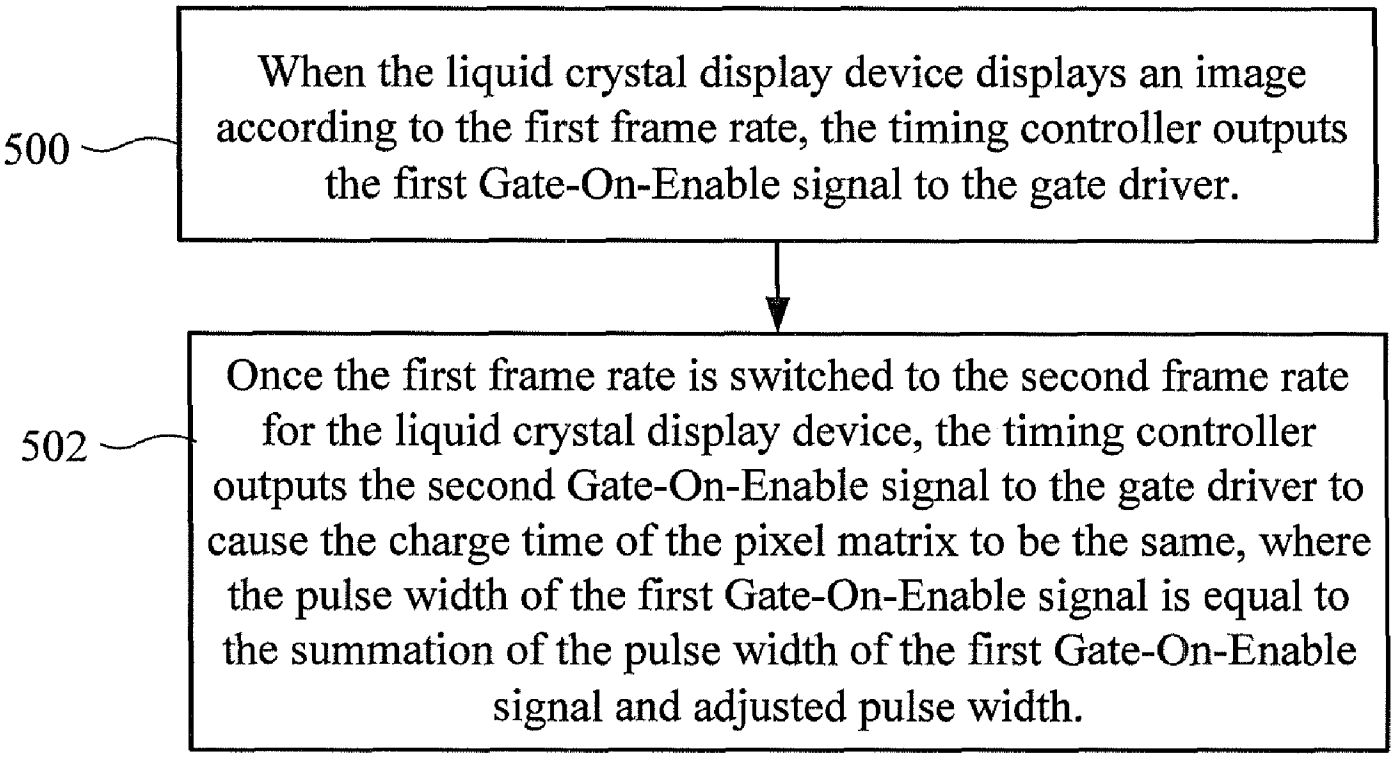
FIG. 5 shows a flow diagram of the driving method of the present invention.

Referring to FIG. 3, FIG. 4, and FIG. 5, FIG. 4 demonstrates a timing diagram of a first Gate-On-Enable signal OE1 and a second Gate-On-Enable signal OE2 upon frame rate being switched from 60 Hz to 40 Hz, and FIG. 5 shows a process flow diagram of the present invention. After outputting the first Gate-On-Enable signal OE (Step 500) to the gate driver 104 based on the first frame rate (i.e. 60 Hz), the timing controller 108 outputs a horizontal initial impulse STH to the source driver 106. Once receiving the Gate-On-Enable signal, the gate driver 104 outputs a scanning signal to the pixel matrix 102. Once receiving the horizontal initial impulse STH, the source driver 106 starts to output a data signal to the pixel matrix 102, which causes the pixel units 120 of the pixel matrix 102 to switch on their corresponding transistors 122 upon receiving the scanning signal, and the liquid crystal capacitor $C_{LC}$ is charged and/or discharged to exhibit gray levels according to the data signal. That is to say, as shown in FIG. 4, within the liquid crystal charge time T1 the pixel matrix 102 is charged and/or discharged according to the data signal. The formula of the liquid crystal charge time T1 is as follows.

$$T1 = \frac{1}{FrameRate \times V_{total}} - \text{OE1_clk} \times \frac{1}{\text{Dot_clk}}, \qquad \text{Equation 1}$$

where FrameRate indicates the first frame rate, $V_{total}$ indicates a total number of vertical pixels, Dot_clk indicates a dot clock, and OE1_clk indicates a pulse width of the first Gate-On-Enable signal.

When the first frame rate (i.e., 60 Hz) is switched to the second frame rate (i.e., 40 Hz), the timing controller 108 outputs the second Gate-On-Enable signal OE2 to the gate driver 104 according to the second frame rate (i.e., 40 Hz) and then outputs a horizontal initial impulse STH to the source driver 106. Upon receiving the horizontal initial impulse STH, the source driver 106 starts to output a data signal to the pixel matrix 102, which is charged and/or discharged to exhibit gray levels according to the data signal. It is noted that, in order to prevent the pixel matrix 102 from producing flicker at the instant of the first frame rate being switched to the second frame rate, it is required to control the situation where the liquid crystal charge time T2 is equal to the liquid crystal charge time T1. If the liquid crystal charge time T2 is identical to the liquid crystal charge time T1, the charge and/or discharge time of the liquid crystal capacitor $C_{LC}$ of the pixel matrix 102 does not be changed at the instant of the switch of frame rate, so the brightness produced by the liquid crystal capacitor $C_{LC}$ according to the data signal is the same as well. In this way, the frame can be prevented from producing flicker at the instant of the switch of frame rate.

Therefore, once detecting that the first frame rate is switched to the second frame rate, the timing controller 108 adjusts the second pulse width OE2_clk of the second Gate-On-Enable signal OE2 to being equal to the summation of the first pulse width OE1_clk of the first Gate-On-Enable signal OE1 and an adjusted pulse width N_clk. As shown in FIG. 4, the formula of the liquid crystal charge time T2 is as follows.

$$T2 = \frac{1}{FrameRate \times k \times V_{total}} - (\text{N_clk} + \text{OE1_clk}) \times \frac{1}{\text{Dot_clk} \times k}, \qquad \text{Equation 2}$$

where k indicates the ratio value of the second frame rate to the first frame rate, and N_clk indicates adjusted pulse width.

T1 is equal to T2, as well as Dot_clk is equal to $V_{total} \times H_{total} \times \text{FrameRate}$, so $$N_clk = OE_clk - H_{total} \times (k-1) \qquad \text{Equation 3}$$

where $H_{total}$ indicates a total number of horizontal pixels.

In other words, the pulse width OE2_clk of the second Gate-On-Enable signal OE2 output by the timing controller 108 is equal to the pulse width OE1_clk and adjusted pulse width N_clk of the first Gate-On-Enable signal OE1 (Step 502 in FIG. 5), so the adjusted pulse width N_clk can be calculated according to Equation 3. In this way, flicker will not occur to the pixel matrix 102 at the instant of the switch from the first frame rate to the second frame rate, for the liquid crystal charge time T2 is equal to the liquid crystal charge time T1.

In contrast to prior art, the liquid crystal display (LCD) device of the present invention can keep the liquid crystal charge time constant by adjusting the clock width of the Gate-On-Enable signal at the instant of the switch from the first frame rate to the second frame rate, so that the frame can be prevented from producing flicker.

Although the present invention has been explained by the embodiments shown in the drawings described above, it should be understood to the ordinary skilled person in the art that the invention is not limited to the embodiments, but rather various changes or modifications thereof are possible without departing from the spirit of the invention. Accordingly, the scope of the invention shall be determined only by the appended claims and their equivalents.

What is claimed is:

1. A method of driving a liquid crystal display (LCD) device, the LCD device comprises a pixel matrix, a timing controller and a gate driver, the method comprising:

(a) the timing controller outputting a first Gate-On-Enable signal to the gate driver, when the LCD device displays frame according to a first frame rate; and (b) when the first frame rate is switched to a second frame rate, the timing controller outputting a second Gate-On-Enable signal to the gate driver to cause a charge time of the pixel matrix to be unchanged, wherein a pulse width of the second Gate-On-Enable signal is equal to a summation of a pulse width of the first Gate-On-Enable signal and an adjusted pulse width N(clk), wherein the adjusted pulse width N(clk) is determined by a total number of horizontal pixels, the pulse width OE(clk) of the first Gate-On-Enable signal, and a ratio K of the second frame rate and the first frame rate.

2. The method of claim 1 wherein the adjusted pulse width N(clk) is a function of $(K-1)\times(OE(clk)-H_{total})$.

3. The method of claim 1 wherein the first frame rate is greater than the second frame rate.

4. The method of claim 1 wherein the timing controller is used for generating a horizontal initial impulse in response to a falling edge of the first Gate-On-Enable signal or the second Gate-On-Enable signal.

5. The method of claim 4 wherein the LCD device further comprises a source driver for outputting a data signal to the pixel matrix upon receiving the horizontal initial impulse, so that the pixel matrix exhibits grey level based on the data signal.

6. A liquid crystal display (LCD) device comprising:

a pixel matrix for displaying an image; and a timing controller for outputting a second Gate-On-Enable signal to the gate driver to cause a charge time of the pixel matrix to be unchanged, when detecting a first frame rate is switched to a second frame rate, wherein a pulse width of the second Gate-On-Enable signal is equal to a summation of a pulse width of the first Gate-On-Enable signal and an adjusted pulse width N(clk), wherein the adjusted pulse width N(clk) is determined by a total number of horizontal pixels, the pulse width OE(clk) of the first Gate-On-Enable signal, and a ratio K of the second frame rate and the first frame rate.

7. The LCD device of claim 6 wherein the adjusted pulse width N(clk) is a function of $(K-1)\times(OE(clk)-H_{total})$.

8. The LCD device of claim 6 wherein the first frame rate is greater than the second frame rate.

9. The LCD device of claim 6 further comprising a gate driver coupled to the pixel matrix for outputting a scanning signal to the pixel matrix upon receiving the first Gate-On-Enable signal or the second Gate-On-Enable signal.

10. The LCD device of claim 9 wherein the timing controller is used for generating a horizontal initial impulse in response to a falling edge of the first Gate-On-Enable signal or the second Gate-On-Enable signal.

11. The LCD device of claim 10 further comprising a source driver for outputting a data signal to the pixel matrix upon receiving the horizontal initial impulse, so that the pixel matrix exhibits grey level based on the data signal.

* * * * *